United States Patent [19]

Jacobsson

[11] 3,999,717

[45] Dec. 28, 1976

[54] THREAD DELIVERY DEVICE FOR TEXTILE MACHINES

[75] Inventor: Kurt Arne Gunnar Jacobsson, Ulricehamn, Sweden

[73] Assignee: Aktiebolaget IRO, Ulricehamn, Sweden

[22] Filed: Sept. 12, 1975

[21] Appl. No.: 612,735

[30] Foreign Application Priority Data

Sept. 16, 1974 Germany ..... 2444186

[52] U.S. Cl. ..... 242/47.01; 66/132 R; 139/452; 242/47.12; 139/122 R

[51] Int. Cl.[2] ..... B65H 51/20

[58] Field of Search ..... 242/47.01, 47.04, 47.05, 242/47.06, 47.07, 47.08, 47.09, 47.1, 47.11, 47.12, 47.13; 66/132 R

[56] References Cited

UNITED STATES PATENTS

| | | | |
|---|---|---|---|
| 3,625,444 | 12/1971 | Hatay | 242/47.01 |
| 3,637,149 | 1/1972 | Frei | 242/47.12 X |
| 3,720,384 | 3/1973 | Rosen | 242/47.01 |
| 3,796,386 | 3/1974 | Tannert | 242/47.12 |
| 3,820,731 | 6/1974 | Rosen | 242/47.12 |
| 3,822,833 | 7/1974 | Fecker | 242/47.12 |
| 3,854,307 | 12/1974 | Seibold | 242/47.01 X |
| 3,883,083 | 5/1975 | Rosen | 242/47.01 |
| 3,904,141 | 9/1975 | Rosen | 242/47.12 |
| 3,908,921 | 9/1975 | Jacobsson | 242/47.01 |
| 3,928,987 | 12/1975 | Jacobsson | 242/47.01 X |

*Primary Examiner*—Stanley N. Gilreath
*Attorney, Agent, or Firm*—Woodhams, Blanchard and Flynn

[57] ABSTRACT

A thread delivery device for a textile machine, which device includes a drum upon which a thread can be tangentially wound to form an intermediate thread storage and from which the thread can be unwound axially over an end of the drum. A thread control member is positioned adjacent the withdrawal end of the drum for engaging the withdrawn thread to limit the withdrawal rate of thread from the drum substantially to the rate at which the thread is wound onto the drum to thereby provide a positive thread supply. A thread guide element is disposed adjacent but radially spaced from the drum, and the last thread winding on the drum (that is, the winding which is about to be withdrawn from the drum) is guided around the thread guide element and then back to the drum so that the last winding thus forms a partial winding on the drum. This thread control element thus ensures that two or more windings are not wound off the drum simultaneously.

9 Claims, 2 Drawing Figures

THREAD DELIVERY DEVICE FOR TEXTILE MACHINES

FIELD OF THE INVENTION

The invention relates to a thread delivery device for textile machines in which a thread running off a storage bobbin can be wound tangentially on to a storage drum in the form of a multilayer intermediate supply and withdrawn overend from the storage drum.

BACKGROUND OF THE INVENTION

A thread delivery device of this type is known from German Patent Specification No. 1,903,133. It has the advantage that, as a result of the intermediate thread supply being wound in the form of a multilayer irregularly wound ball of thread on to a device of predetermined size, a substantially larger intermediate thread supply can be stored than when thread is stored in a single layer, which was hitherto the only method in use. The known device has proved the most successful in practice; in particular, the thread running off may be detached from the ball of thread without pulling occurring.

German Auslegeschrift No. 1,760,600 discloses a thread delivery device providing a thread control element which is movable into the path of the thread running off the drum and limits the relative rotation of the withdrawn thread about the storage drum, thus preventing the withdrawal speed of the thread from exceeding its wind-on speed. A positive thread feed is achieved in this way despite the thread being withdrawn overend from the drum. The latter type of apparatus also operates satisfactorily if the intermediate thread supply is wound on to its storage drum in the form of a multilayer ball of thread. However, there are certain qualities of thread in which there is a very great degree of adhesion between adjacent thread windings. This occurs for example when the thread is a mixed yarn consisting of different long, loose and strong fibres. In such cases it occasionally happens that the final winding in front of the braking device, i.e. the next winding to be drawn off, tears the following winding and sometimes even another winding, thereby causing an abrupt drop in tension.

The problem underlying the invention is, in the case of a thread delivery device of the initially described type, to ensure that two or more windings are not wound off the storage drum simultaneously during positive thread delivery, also when closely adhering yarns are processed.

This problem is solved in accordance with the invention in that, when there is a positive thread feed in which the thread running off the storage drum engages on a lateral thread control element in a manner known per se, which control element limits the thread unwinding speed to the thread wind-on speed, the last thread winding which is situated directly in front of the braking device and is the next winding to be drawn off the storage drum is guided by the drum via a thread guide element, radially spaced from the drum and fixed relative to the thread control element, and guided back thereby to form a partial winding on the storage drum.

In the thread delivery device according to the invention the last thread winding slightly in front of the unwinding station forms a loop around the thread guide element. In this way the thread only comes into contact with part of the circumference of the storage drum.

The area of contact between the final thread winding and the previous winding is greatly reduced thereby and it can no longer happen that the final thread winding tears the previous windings adjacent thereto.

In a thread delivery device in which the storage drum is rotatable and the thread control element is mounted on a support arm extending outside the storage drum parallel to the drum axis, such as shown in U.S. Pat. No. 3,908,921, it is advantageous if the final thread winding is wound round the support arm. As a result of this, additional structural components are not required to separate the final thread winding partially from the adjacent windings.

In a thread delivery device in which the storage drum is fixed and the thread control element mounted on a rotatable thread winding element, as also shown in U.S. Pat. No. 3,908,921, the thread guide element is preferably in the form of a guide rod projecting from the thread winding element parallel to the drum axis.

The thread control and guide elements advantageously have little or no angular spacing relative to the storage drum axis. This ensures that the final thread winding still has a sufficient degree of winding.

The surface of the thread guide element which is in contact with the last thread winding is preferably designed to be low in friction. When the storage drum or winding element rotates, the final thread winding runs over and beyond the surface of the thread guide element so that friction must be kept particularly low at this point.

BRIEF DESCRIPTION OF THE DRAWINGS

Practical embodiments of the invention are illustrated in the drawings.

DETAILED DESCRIPTION

Figure 1:
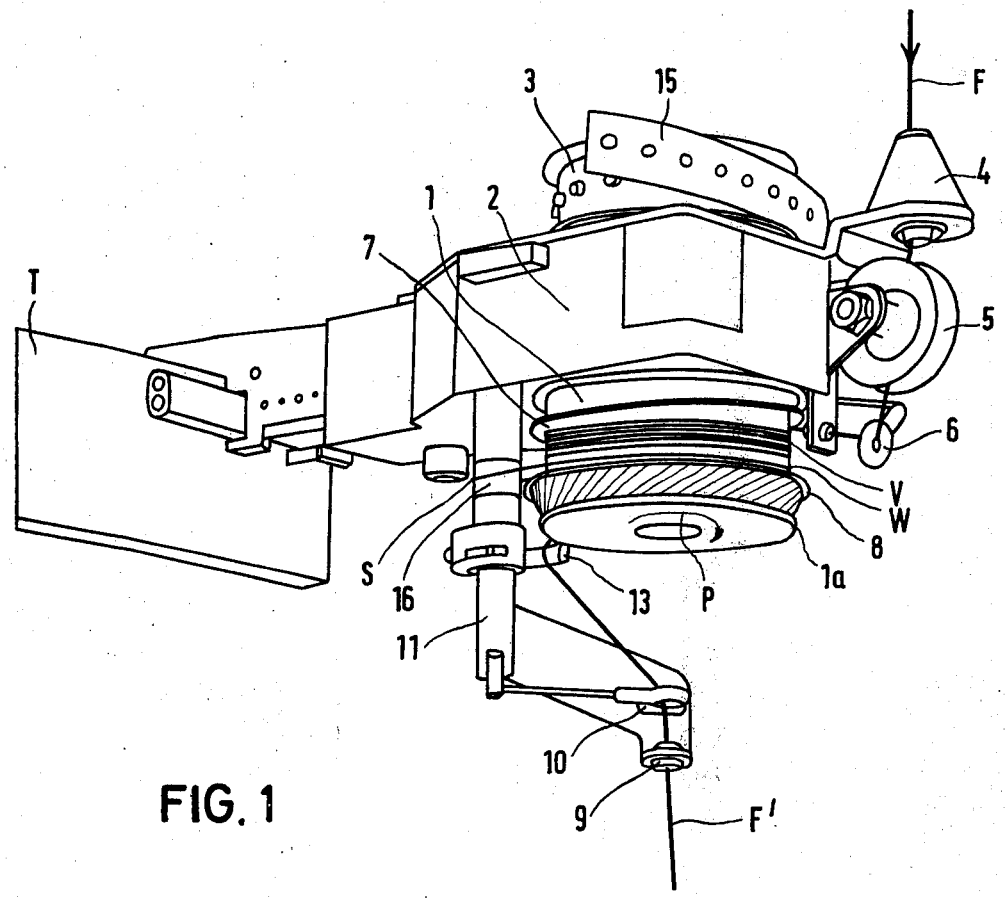
FIG. 1 is a perspective view of a first embodiment of a thread feeder according to the invention with a rotary storage drum.

In FIG. 1 reference numeral 1 designates storage drum rotatably mounted in a housing 2. The housing is clamped to a ring support T of a textile machine, particularly a knitting machine, knitting machines being provided with a plurality of thread feeders corresponding to the number of knitting systems. The drum 1 is driven via a studded wheel 3 and a punched belt 15 cooperating with said studded wheel and being driven synchronously with the textile machine. The thread F runs off a storage bobbin (not shown) and passes through a preliminary brake 4, a disc brake 5 and a stop motion 6 in order to be tangentially wound on to the storage drum rotating in the direction of the arrow P. The storage drum 1 is associated with an inclined control disc 7, which has been described in detail for example in the already mentiond German Auslegeschrift 1,760,600 and feeds the forming thread windings in the axial direction of the thread drum so that an intermediate thread supply V is formed on the drum. In practice, the thread windings in the intermediate thread supply V do not lie next to one another as shown diagrammatically in the drawing; on the contrary, the thread windings are laterally superposed and form a two-layered or multilayered relatively irregularly wound ball of thread. The thread is withdrawn overend from the ball by a brake ring 8 comprising a plurality of fingers and via a lower withdrawal edge 1*a* of the storage drum. Coaxially with the axis of the storage drum there is provided a withdrawal guide 9 with a stop motion 10 arranged in front of said guide through which the running off thread F′ is fed to the textile machine.

The withdrawal guide 9 and the stop motion 10 are mounted on the free end of a support arm 11 which extends outside the storage drum 1 and parallel to the axis thereof, the upper end of the support arm being mounted in the housing 2.

Mounted on the support arm 11 directly below the withdrawal edge 1*a* of the storage drum 1 is a hook 13 which is normally in the position shown in FIG. 1. When in this position it engages the area of the running off thread F′. The hook is open in the direction of rotation P of the storage drum 1. The running off thread F′, which tends to rotate about the withdrawal edge 1*a* of the storage drum 1 in the opposite direction of rotation to that of the drum as a result of the tension acting thereon in the direction of withdrawal, is therefore inserted into the hook opening and prevented by the hook 13 from moving any further laterally around the withdrawal edge 1*a*. Therefore, only the same amount of thread can be withdrawn as is released by the drum as a result of its rotation in the direction P. The withdrawal speed of the thread is thereby limited to its wind-on speed. This is the normal mode of operation for the thread feeder which is intended primarily for positive thread delivery.

Alternatively, the hook 13 can be swung out the area of movement of the thread F′ so that any of the threads can be removed from the intermediate supply V for repair or adjustment purposes. In order to prevent the last thread winding W, which is about to be drawn off in a downward direction, from pulling along the following windings or windings lying above or below, it is wound in the illustrated embodiment around the section 16 of the support arm having a polished low-friction surface at this point. The last winding W therefore forms a loop S which extends laterally from the drum 1 and around the section 16 of the support arm 11. The thread in the final winding therefore leaves the storage drum in a tangential direction, is wound round the section 16 of the support arm 11 acting as a thread guide element, guided back therefrom tangentially to the storage drum 1 and then withdrawn only downwardly by the brake ring 8 and via the hook 13.

Figure 2:
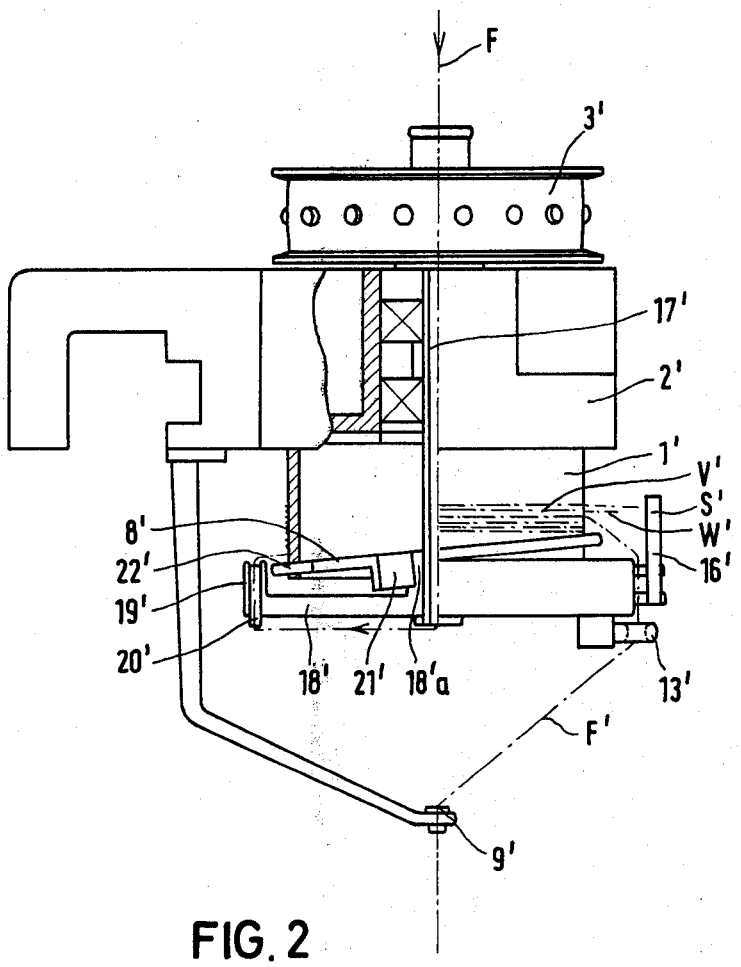
FIG. 2 is a side elevation, in partial section, showing a second embodiment of a thread feeder according to the invention.

In the embodiment shown in FIG. 2 a storage drum 1′ is rigidly connected to a housing 2′ which is clamped on a ring support of a textile machine by means of a clamping device in the same manner as in FIG. 1. The drum 1′ and the housing 2′ are penetrated by a hollow shaft 17′ on which a studded wheel 3′ is keyed. The latter is also driven together with a punched belt (not shown) synchronously with the textile machine. A disc 18′ is non-rotatably mounted on the lower free end of the hollow shaft 17′, the outer edge of said disc carrying a flange-like ring 19′. This ring encloses the lower free edge of the storage drum 1′. The ring 19′ contains a thread guide 20′. The elements 18′ – 20′ form a rotary wind-on element for the thread F from a storage bobbin (not shown) which thread passes through the hollow shaft 17′, is then radially outwardly diverted, guided through the thread guide 20′ and wound therefrom tangentially on to the storage drum 1′. Obliquely mounted on a hub 18′*a* of the disc 18′ is a ball bearing 21′ about which a control wheel 8′ rotates with arms 22′ extending outwardly through longitudinal slots in the wall of the drum 1′. The arms 22′ are joined on the outside by a ring. The arrangement is such that the control wheel 8′ with its arms 22′ conveys the thread windings wound on to the drum 1′ upwardly in the axial direction of the drum 1′ so that an intermediate thread supply V′ is again formed on the storage drum. Just as in FIG. 1, the windings in this intermediate thread supply V′ are not arranged in juxtaposition with one another; on the contrary, through the superposed winding of two or more layers, they form an irregular and relatively loose ball of thread.

The thread, as indicated by F′, of the intermediate thread supply V′ is withdrawn overend from the storage drum 1′. In this connection it runs over the outer face of the ring 19′ into a central withdrawal eyelet 9′.

A hook 13′ is mounted on the lower side of the wheel 18′ and is normally in the position shown in FIG. 2 with its opening projecting radially over the circumference of the wheel 18′. In this position the running off thread F′ cannot rotate faster about the lower edge of the drum 1′ than the ring 19′. The thread F′ is caught in the opening of the hook 13′ and cannot therefore "outpace" the hook. Since the rotational speed of the ring 19′ and eyelet 20′ determines the wind-on speed of the thread, the withdrawal speed is therefore limited to the wind-on speed. A positive thread feed is thus provided.

The hook 13′ can also be swung inwardly when an intermittent thread feed is occasionally required for repair or adjustment purposes. Also, to prevent the final thread winding W′ in this embodiment from tearing adjacent windings, a guide element in the form of a rod 16′ is attached to the outside of the ring 19′ extending parallel to the axis of the drum 1′. The final thread winding W′ forms a loop S′ around the rod 16′. The thread F′ therefore runs tangentially off the storage drum 1′, around the rod 16′, back in a tangential direction to the storage drum 1′ and thence down via the ring 19′ into the hook 13′ and the withdrawal guide 9′.

If the withdrawal tension threatens to become too low, a braking device can be provided in this case also, by sliding on to the storage drum 1′ a plastic disc which is laid on to the intermediate thread supply V′ from above.

The invention is not limited to the illustrated embodiments. In particular, the thread control element can also be designed differently from the hook 13 or 13′. The only essential requirement is an element with which the running off thread comes into contact and is prevented thereby from being withdrawn more rapidly than it is wound on. Also, the thread guide element 16 or 16′ does not need to be a support arm or a rod. In this case also, the only important requirement is for the final thread winding to be radially lifted clear of the drum circumference for part of its length so that the area of contact between the final winding and adjacent windings is greatly reduced.

As can be seen in the drawings, there is practically no angular spacing between the thread control element 13 or 13′ and the thread guide element 16 or 16′. However, a certain angular spacing can naturally be provided. It is only important that the angular spacing should not become so great that the thread F′ runs directly from the thread guide to the thread control element. It has to run back again from the thread guide element to the storage drum and partially wind round the latter.

I claim:

1. In a thread supply device for a textile machine, said thread supply device including drum means upon which a thread can be tangentially wound to form an intermediate thread storage and from which the thread can be withdrawn past a braking device and over the end of the drum means, a thread control member positioned adjacent the drum means for engaging the withdrawn thread to limit the withdrawal rate of thread from said drum means substantially to the rate at which thread is wound on the drum means to thereby provide a positive thread supply, the improvement comprising a thread guide element radially spaced from the drum means and disposed in engagement with the last thread winding which is about to be withdrawn from the drum means, said last thread winding being guided around the thread guide element and then guided back therefrom to form a partial winding on the drum means.

2. A thread delivery device according to claim 1, wherein said drum means is mounted for rotation about its longitudinal axis, and wherein the thread control element is mounted on a support arm which is disposed radially outwardly of the drum means and extends substantially parallel to the drum axis, said support arm functioning as said thread guide element so that said last thread winding is wound around said support arm.

3. A thread delivery device according to claim 1, wherein said drum means is stationarily mounted, a thread-winding element being supported for rotation relative to said drum means, said thread control element being mounted on said rotatable thread-winding element, and said thread guide element comprising a guide rod mounted on said thread-winding element and projecting therefrom in a direction substantially parallel to the axis of said drum means.

4. A thread delivery device according to claim 1, wherein the thread control element and the thread guide element are positioned closely adjacent one another relative to the circumferentially extending direction of said drum means.

5. A thread delivery device according to claim 1, wherein the thread guide element has a surface thereon which is of low friction, said surface being disposed for engagement with said last thread winding.

6. A thread delivery device according to claim 1, wherein said thread control element and said thread guide element are fixedly related with respect to one another during operation of the device for providing a positive thread supply.

7. A thread delivery device according to claim 6, including a braking device mounted on said drum means and disposed for engaging said last thread winding.

8. A thread delivery device according to claim 1, wherein one of said drum means and thread guide element is mounted for rotation about an axis which is aligned with the longitudinal axis of said drum means, and wherein the other of said drum means and thread guide element is stationary.

9. A thread delivery device according to claim 8, wherein the thread control element and the thread guide element are fixed relative to one another during operation of the device for providing a positive thread supply, and including a braking device associated with the drum means and disposed for engagement with said last thread winding.

* * * * *